United States Patent [19]

Peters

[11] Patent Number: 4,487,416

[45] Date of Patent: Dec. 11, 1984

[54] ROTATABLE KICKER FOR PINBALL GAME

[75] Inventor: Albin Peters, Chicago, Ill.

[73] Assignee: Wico Corporation, Niles, Ill.

[21] Appl. No.: 409,414

[22] Filed: Aug. 19, 1982

[51] Int. Cl.[3] ..... A63F 7/00

[52] U.S. Cl. ..... 273/129 V; 273/129 S

[58] Field of Search ..... 273/129 V, 129 S, 119 A, 273/121 A, 119 R, 124 A, 122 A, 125 A, 123 A, 85 E, 85 A; 200/61.11, 61.1; 124/32, 54

[56] References Cited

U.S. PATENT DOCUMENTS

| | | | |
|---|---|---|---|
| 2,100,280 | 11/1937 | Goldberger | 273/309 |
| 2,219,934 | 10/1940 | Nelson | 273/119 A |
| 2,872,193 | 2/1959 | Hamilton | 273/119 A |
| 3,404,888 | 10/1968 | Lally et al. | 273/121 A |
| 3,870,307 | 3/1975 | Meyer et al. | 273/121 A |
| 4,203,602 | 5/1980 | Kral | 273/121 A |

*Primary Examiner*—Richard C. Pinkham

*Assistant Examiner*—T. Brown

*Attorney, Agent, or Firm*—Emrich & Dithmar

[57] ABSTRACT

A rotatable kicker apparatus includes a frame adapted to be mounted in an aperture in the playfield board of a pinball game for rotation about an axis perpendicular to the playfield board. The frame carries a drive solenoid which connects through crank arm linkage to a kicker member which is disposed for sliding reciprocating movement in a track in the frame parallel to the playfield board. Spaced-apart metal contact plates in the solenoid circuit are disposed on the frame to be bridged by a rolling pinball for actuating the kicker solenoid. The frame is mounted on a rotating shaft which is rotatably driven by an associated electric motor to vary the kicking direction. A control circuit includes control switches for respectively rotating the frame in opposite directions from a neutral rest position, the frame automatically returning to the rest position upon release of the switch.

19 Claims, 7 Drawing Figures

ROTATABLE KICKER FOR PINBALL GAME

BACKGROUND OF THE INVENTION

The present invention relates to pinball games and, in particular, to ball kicker apparatus for such games.

The present invention is an improvement of the kicker apparatuses disclosed in application Ser. No. 338,314, filed Jan. 11, 1982 and entitled "Horizontally Movable Kicker for Pin Ball Game", and in application Ser. No. 409,411, filed Aug. 19, 1982, entitled "Wide Face Horizontally Movable Kicker for Pin Ball Game". Both of these applications disclose kicker apparatus of the type wherein a rolling pinball actuates a solenoid to drive a kicker member into horizontally reciprocating movement along a track for kicking engagement with the pinball. However, these kicker apparatuses are capable of kicking the pinball in only a single predetermined direction and are not controllable by the player.

It is known to provide rotating apparatus for propelling a pinball in varying directions. Thus, in application Ser. No. 326,172, filed Nov. 30, 1981, U.S. Pat. No. 4,437,664 issued Mar. 20, 1984 and entitled "Pin Ball Game with Oscillating Shooter", there is disclosed an automatically continuously oscillating shooter mechanism which includes a socket for receiving a spent pinball and a player-controlled actuating means for ejecting the pinball from the socket when the shooter is pointed in the desired direction. But the oscillating mechanism is not controllable by the player, and the device is adapted for ejecting a pinball from a socket and is not adapted for use as a kicker mechanism in a pinball game.

SUMMARY OF THE INVENTION

The present invention relates to an improved rotatable kicker apparatus for a pinball game, which avoids the disadvantages of prior kicker apparatuses while affording additional structural and operating advantages.

It is an important object of this invention to provide an apparatus for effecting rotation of a horizontally movable kicker apparatus for a pinball game.

It is another object of this invention to provide a rotatable kicker apparatus which is selectively rotatable by the player of the pinball game.

In connection with the foregoing object, it is another object of this invention to provide a rotatable kicker apparatus of the type set forth which is selectively rotatable in either direction.

In connection with the foregoing objects, still another object of the invention is the provision of a selectively operable rotatable kicker apparatus of the type set forth which includes a horizontally movable kicker member.

These and other objects of the invention are attained by providing A rotatable kicker apparatus for a pinball game including a playfield board on which a pinball rolls, the kicker apparatus comprising a frame rotatable about an axis disposed substantially perpendicular to the associated playfield board, a kicker member carried by the frame for reciprocating kicking movement substantially parallel to the playfield board to engage the associated pinball and propel it along the playfield board in a predetermined direction relative to the frame, kicker drive means carried by the frame and coupled to the kicker member for effecting kicking movement thereof, and frame drive means coupled to the frame for effecting rotational movement thereof about the axis thereby to vary the predetermined direction.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
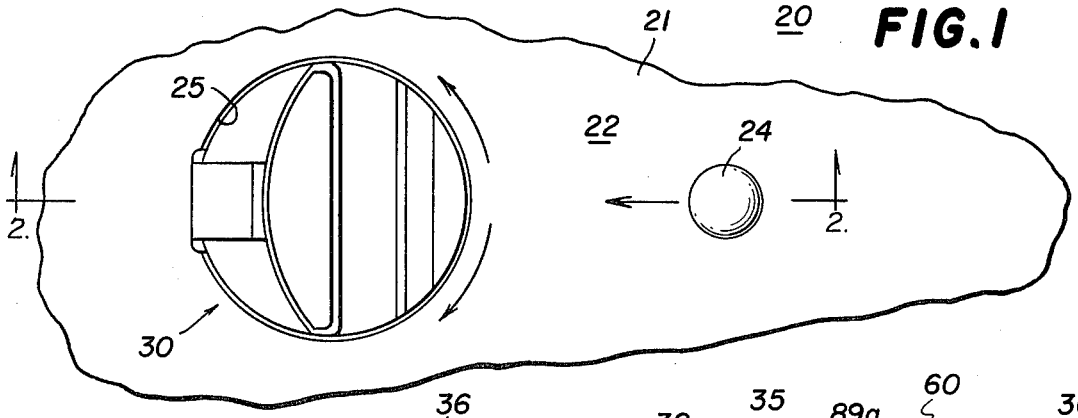
FIG. 1 is a perspective top plan view of a portion of a pinball game playfield board incorporating a rotatable kicker apparatus constructed in accordance with and embodying the features of the present invention.
Figure 3:
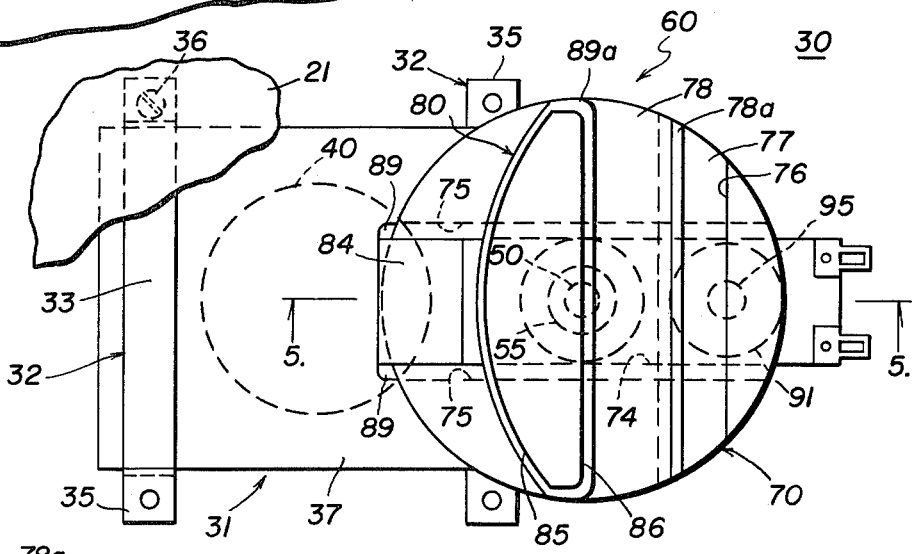
FIG. 3 is a top plan view of the kicker apparatus of FIG. 2.
Figure 2:
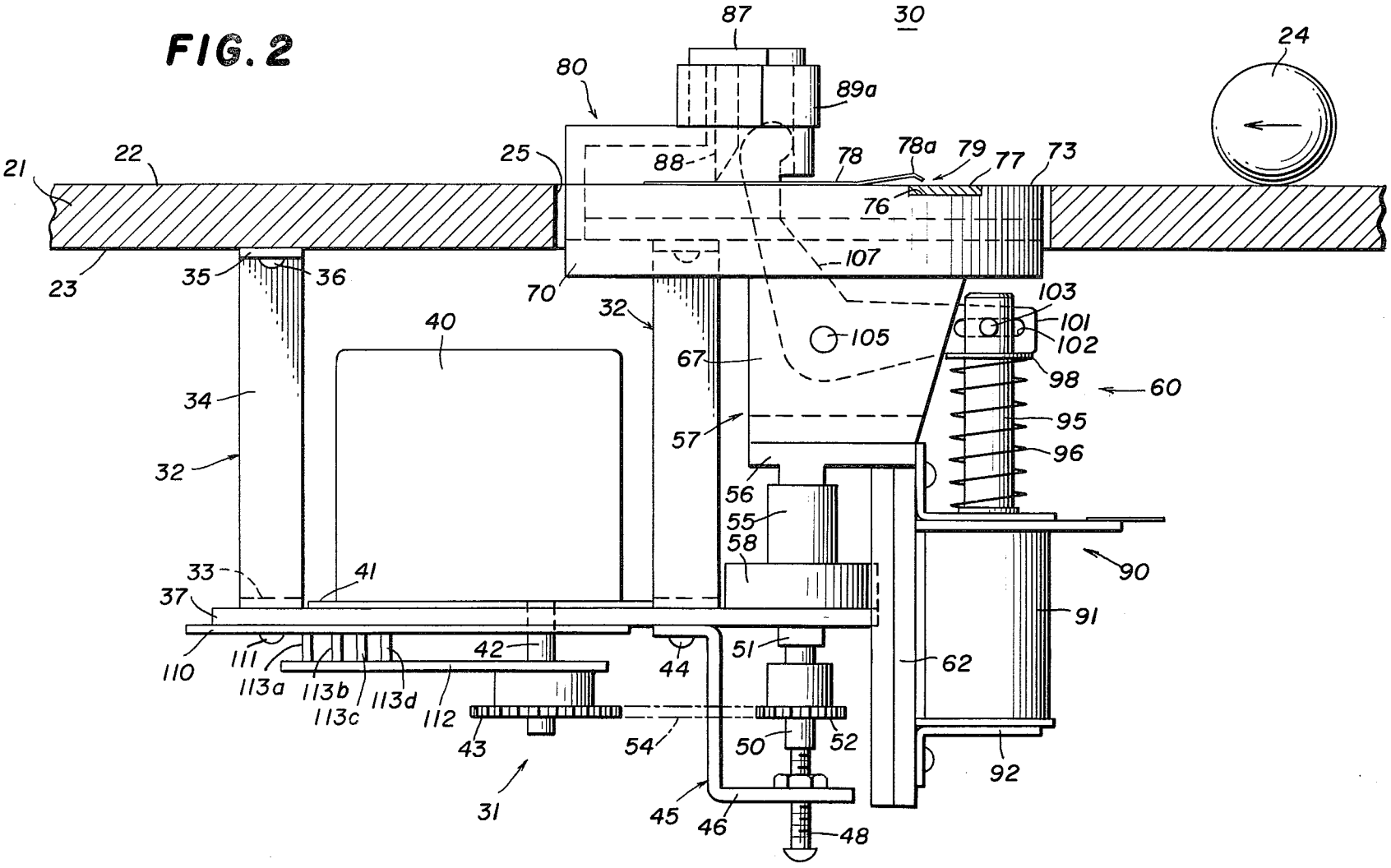
FIG. 2 is a sectional view taken along the line 2—2 in FIG. 1, and illustrating the kicker apparatus in side elevation in its retracted position.
Figure 4:
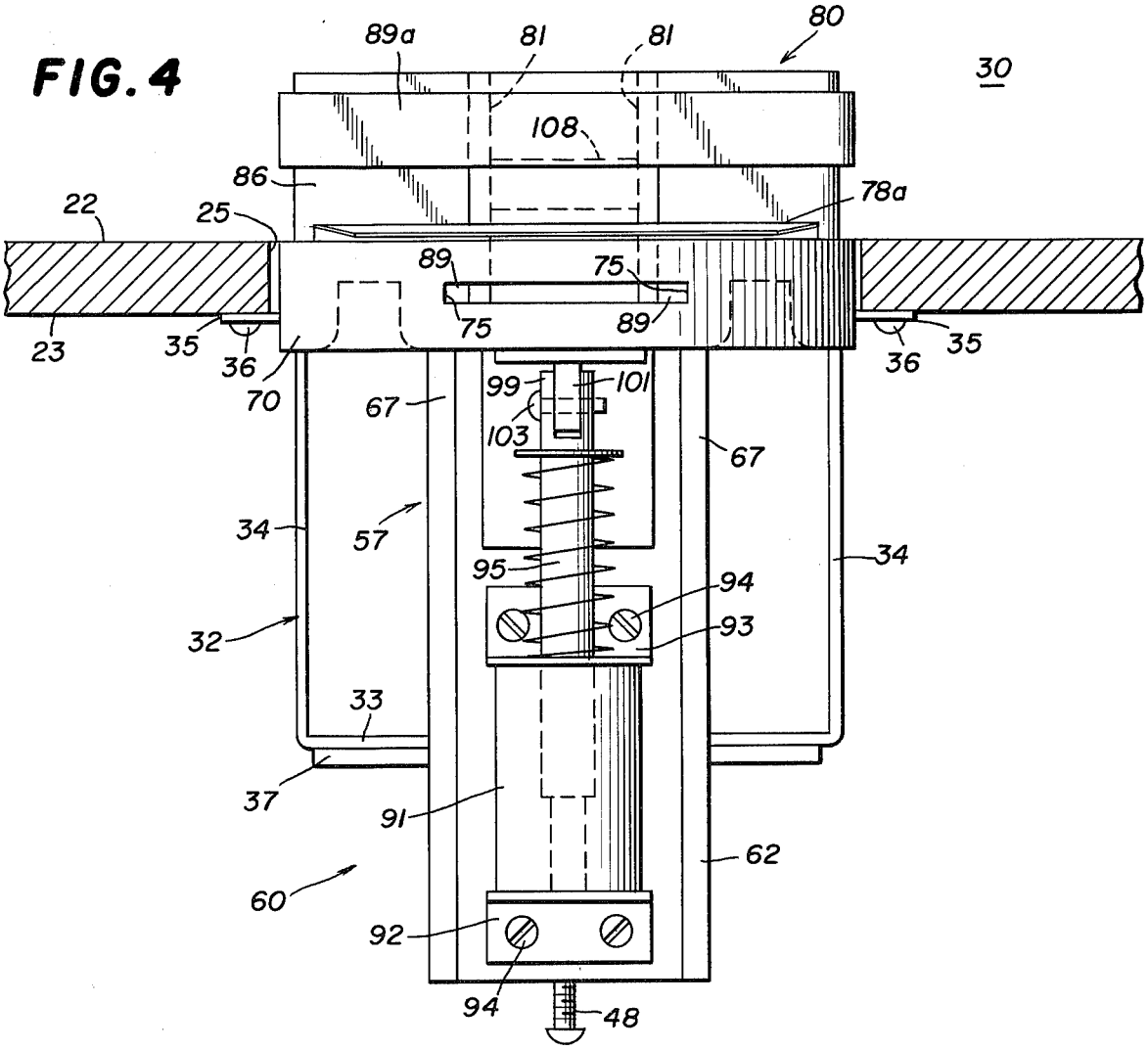
FIG. 4 is an end elevational view of the kicker apparatus of FIG. 2, as viewed from the right-hand end thereof as mounted on the playfield board.
Figure 5:
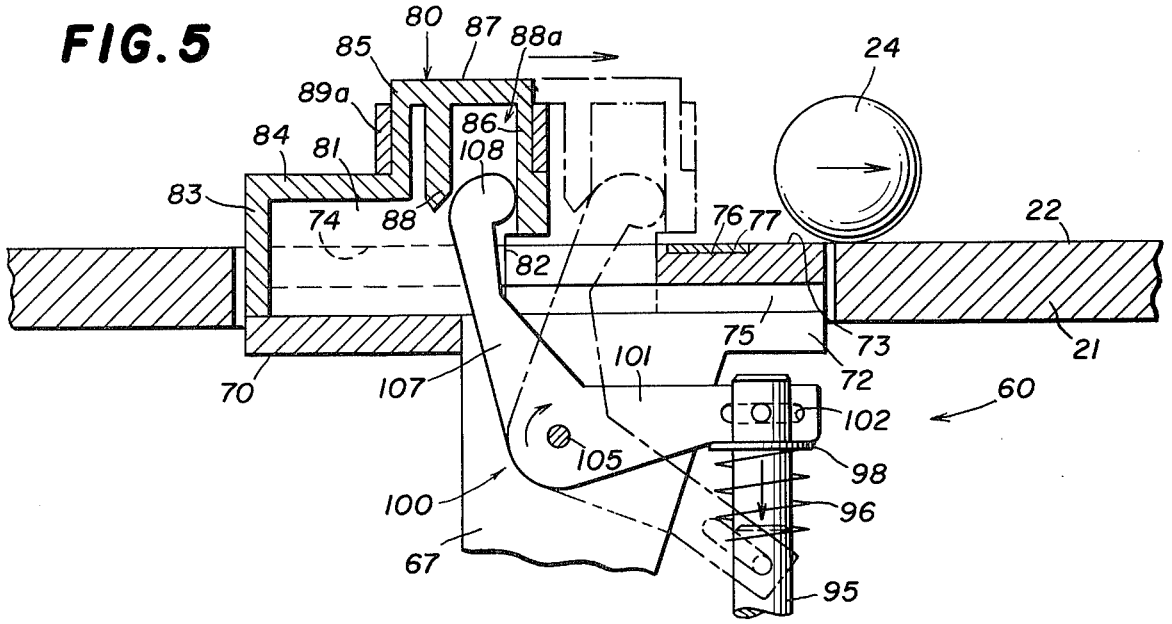
FIG. 5 is a fragmentary view in vertical section taken along the line 5—5 in FIG. 3 and illustrating the kicker member in its retracted position in solid line and in its kicking position in broken line.

Referring to FIG. 1 of the drawings, there is illustrated a portion of a pinball game, generally designated by the numeral 20, which includes a playfield board 21 having an upper surface 22 and a lower surface 23 (see FIG. 2). One or more pinballs 24 are adapted to roll along the upper surface 22 of the playfield board 21 for engagement with target assemblies (not shown) in a well known manner. Formed in the playfield board 21 is a circular aperture 25 for receiving a rotatable kicker assembly, generally designated by the numeral 30, constructed in accordance with and embodying the features of the present invention. There may also be formed, either in the playfield board 21 or elsewhere on the associated pinball game 20, switch apertures for receiving therein switch buttons 29 (see FIG. 7) for controlling the operation of the rotatable kicker assembly 30 in a manner to be explained below.

Referring now also to FIGS. 2 through 5 of the drawings, the rotatable kicker assembly 30 has a rotation mechanism, generally designated by the numeral 31, which includes a pair of spaced-apart U-shaped mounting brackets 32, each of which has a bight portion 33 and a pair of upstanding legs 34, each provided at the upper end thereof with an outturned attachment flange 35 fixedly secured to the lower surface 23 of the playfield board 21, as by fasteners 36. Fixedly secured to the bight portions 33 of the mounting brackets 32 and disposed substantially parallel to the playfield board 21 is a flat mounting plate 37.

Carried on the mounting plate 37 is a reversible electric motor 40 having an attachment flange 41 (FIG. 2) for receiving suitable fasteners to secure the motor 40 to the mounting plate 37. The motor 40 has an output shaft 42 which projects downwardly through a complementary aperture in the mounting plate 37. Fixedly secured to the shaft 42 at the distal end thereof is a sprocket 43. Fixedly secured to the lower surface of the mounting plate 37 as by fasteners 44 is a generally Z-shaped bracket 45 which has a bearing flange 46 carrying a suitable adjustable bearing screw 48 having a pointed end engaging the distal lower end of an elongated shaft 50, to which is fixedly secured a sprocket 52. The sprockets 43 and 52 are interconnected by an endless drive chain 54. The shaft 50 extends upwardly through a complementary aperture in the mounting plate 37. The upper end 51 of the shaft 50 is rectangular in transverse cross-section and is received through a spacer 55, the upper end of the shaft 50 being integral with a support plate 56 of a frame generally designated by the numeral 57. The spacer 55 serves to maintain the spacing between the upper end of the shaft 50 and the mounting plate 37, and has an enlarged oblong lower portion 58.

The kicker assembly 30 also includes a kicker mechanism, generally designated by the numeral 60, which is disposed beneath the playfield board 21. More particularly, the kicker mechanism 60 includes the frame 57, which has a generally rectangular main plate 62 which is integral with the support plate 56 and depends therefrom substantially normal thereto substantially parallel to the shaft 50 and spaced therefrom. Integral with the support plate 56 and projecting upwardly therefrom respectively along opposite sides thereof are two bearing flanges 67, each substantially perpendicular to the support plate 56 and to the main plate 62.

A generally cylindrical turntable 70 is integral with the upper ends of the bearing flanges 67, the turntable 70 having a rectangular opening 72 therein (see FIG. 5) which is disposed between the bearing flanges 67. The turntable 70 is disposed in the circular aperture 25 of the playfield board 21 coaxially therewith. The turntable 70 has a flat circular top surface 73 in which is formed an elongated rectangular channel 74 which extends diametrically partway across the turntable 70 and communicates with the opening 72. Two elongated rectangular track grooves 75 are respectively formed in the opposite side walls of the channel 74, the grooves 75 extending entirely across the turntable 70. Also formed in the top surface 73 of the turntable 70 and extending along a chord across the end of the turntable 70 not traversed by the track channel 74 is a shallow recess 76 arranged so as to be substantally bisected by the longitudinal axis of the track channel 74. Disposed in the recess 76 and fixedly secured to the turntable 70 as by a suitable adhesive, is a flat metal plate 77 formed of a suitable electrical conductor such as copper. Fixedly secured to the top surface 73 of the turntable 70 along the sides of the track channel 74 is a second metal plate 78 formed of a second electrical conductor, the plate 78 having a forward end thereof extending across the track channel 74 and bent to form a resilient contact blade **78*a* overlapping the metal plate 77 substantially parallel thereto and spaced a predetermined slight distance therefrom to define a gap 79 therebetween (see FIG. 2**).

The kicker mechanism 60 includes a kicker member, generally designated by the numeral 80, which is a hollow open-bottom structure, preferably of integral one-piece construction, including a pair of parallel spaced-apart side walls 81. Each of the side walls 81 is provided with a rectangular recess 82 (FIG. 5) at the lower front corner thereof. The side walls 81 are interconnected by an upstanding rear wall 83 at the rear ends thereof and by a flat horizonral deck 84 projecting forwardly from the end of the rear wall 83 about the half way along the length of the side wall 81. Integral with the front edge of the deck 84 and extending upwardly therefrom and laterally outwardly well beyond the side walls 81 is an elongated arcuate peripheral wall 85 closed at the front end thereof by a flat front wall 86 which extends across the front ends of the side walls 81. The peripheral wall 85 and the front wall 86 are closed at the other end thereof by flat top wall 87. Integral with the top wall 87 and extending downwardly therefrom between the side walls 81 and substantially parallel to the front wall 86 is a rectangular septum 88 cooperating with the side walls 81 and the front wall 86 to define a slot **88*a* therebetween. Respectively integral with side walls 81 and projecting laterally outwardly therefrom at the lower edges thereof rearwardly of the periphepal wall 85 are two guide flanges 89 which are respectively slidably disposable in the track grooves 75 of the turntable 70. The side walls 81 are spaced apart a distance such that they will fit within the track channel 74 of the turntable 70. Resiliently encircling the peripheral wall 85 and the front wall 86 is an endless elastic band 89*a***, which may be formed of rubber or the like.

The kicker mechanism 60 also includes a drive solenoid, generally designated by the numeral 90, which includes a coil 91, the opposite ends of which are respectively secured to bottom and top brackets 92 and 93, which are in turn fixedly secured, as by fasteners 94, to the main plate 62 of the frame 61. The solenoid 90 has a plunger rod or armature 95, the solenoid 90 being oriented so that the plunger rod 95 projects upwardly therefrom with the axis thereof disposed substantially perpendicular to the playfield board 21. A compression spring 96 is disposed in surrounding relationship with the plunger rod 95 and is retained thereon between the top bracket 93 and an E-ring retainer 98.

The upper end of the plunger rod 95 is formed as a clevis 99 which receives therein one arm 101 of a drive crank 100. More particularly, the arm 101 has an elongated slot 102 (FIG. 5) therethrough in which is received a coupling pin 103 for pivotally coupling the arm 101 to the clevis 99. The drive crank 100 is disposed between the spaced-apart bearing flanges 67 on the frame 57 and is adapted for pivotal movement about the axis of a pivot pin 105 which extends through complementary openings in the bearing flanges 67 and through a complementary opening in the drive crank 100. Preferably, the pivot pin 105 is disposed below the turntable 70, and with the axis thereof disposed substantially parallel to the playfield board 21 and perpendicular to the path defined by the track channel 74. The other arm 107 of the drive crank 100 projects upwardly through the opening 72 and the circular aperture 25 and into the slot **88*a* in the kicker member 80, the arm 107 having an enlarged rounded end 108 disposed for engagement with the kicker member front wall 86**.

A printed contact board 110 is fixedly secured to the bottom surface of the mounting plate 37 as by fasteners 111. The contact board 110 is provided with a wiper arm 112 which is fixedly secured to the motor output shaft 42 and projects radially outwardly therefrom. The wiper arm 112 is formed of an electrically insulating material such as a suitable plastic, and has fixedly secured to the upper surface thereof a plurality of interconnected electrically conductive wiper fingers 113*a*, 113*b*, 113*c* and 113*d* which are resiliently urged into engagement with the contact board 110.

Figure 7:
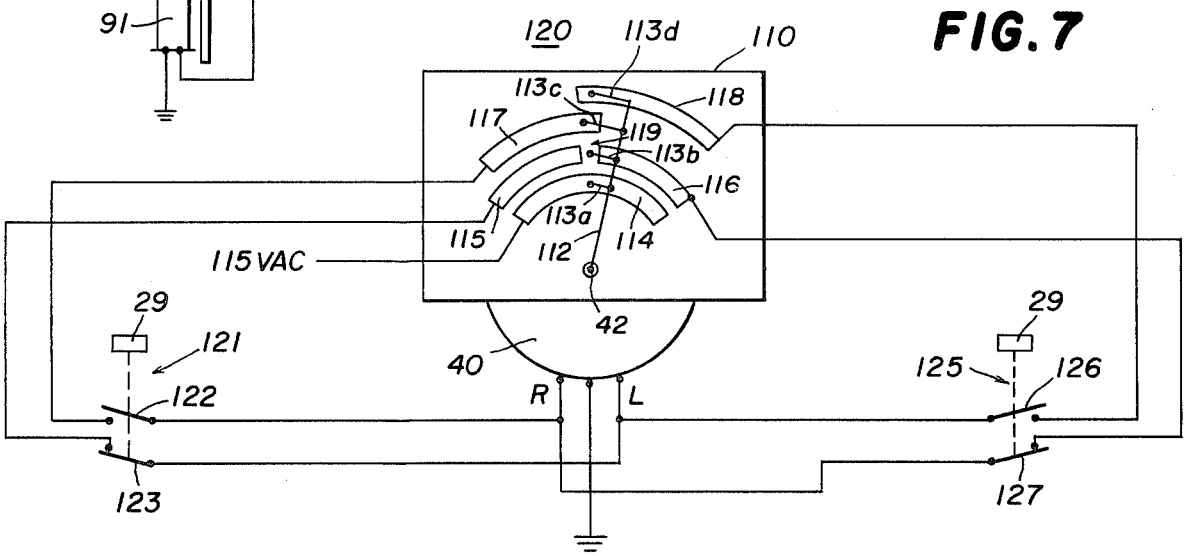
FIG. 7 is a schematic circuit diagram of an electrical control circuit for the kicker apparatus of the present invention.

Referring to FIG. 7, the contact board 110 is provided with a plurality of printed, electrically conductive pads thereon arranged along four concentric arcs of different radii all coaxial with the motor output shaft 42, the wiper fingers 113*a–d* being respectively disposed for travel along these four arcs. More specifically, the contact board includes an inner arcuate source pad 114 adapted to be connected to an associated source of AC electric power. The contact board 110 also includes, along the next arc, right and left return pads 115 and 116 of approximately equal length and separated by a short gap 119. Along the next largest arc there is formed a right advance pad 117 which subtends approximately the same angle as the right return pad 115, but which extends across the gap 119 between the return pads 115 and 116. Formed on the outermost arc is a left advance pad 118, which overlaps the right advance pad 117 in the region of the gap 119 between the return pads 115 and 116.

The kicker assembly 30 includes a control circuit, generally designated by the numeral 120 in FIG. 7, which includes right and left control switches 121 and 125, each being a double-pole, single-throw switch and being actuated by one of the switch buttons 29. More specifically, the right control switch 121 includes poles 122 and 123 and the left control switch 125 includes poles 126 and 127. The movable contacts of the poles 122 and 127 are connected to each other and to the right control terminal R of the motor 40, while the movable contacts of the poles 123 and 126 are connected to each other and to the left control terminal L of the motor 40. The fixed contacts of the poles 122 and 123 are respectively connected to the right advance and return pads 117 and 115 of the contact board 110, while the fixed contacts of the poles 126 and 127 are respectively connected to the left advance and return pads 118 and 116. The motor 40 is preferably a 115 VAC motor, the AC source being connected across the neutral terminal of the motor 40 and the source pad 114 of the contact board 110. While, for simplicity and convenience, the drawing illustrates the contact board 110 and the switches 121 and 125 in the 115 VAC circuit of the drive motor 40, it will be appreciated that the AC source could be connected to the drive motor 40 through relays, in which case a suitable transformer and rectifier would be provided to afford the necessary DC voltage for the relays.

Figure 6:
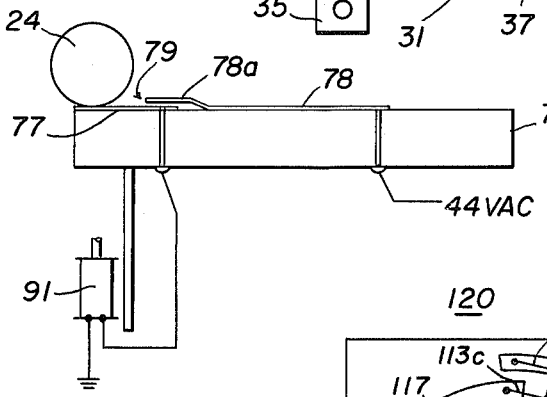
FIG. 6 is a diagrammatic view of the kicker apparatus of FIG. 3 in side elevation as viewed from the upper side of FIG. 3 and illustrating the solenoid actuation mechanism.

It will also be noted, referring to FIG. 6, that one terminal of the kicker drive solenoid coil 91 is connected to the metal plate 77, while the associated AC source is connected across the other terminal of the coil 91 and the other metal plate 78. Preferably, the source voltage is 44 vac and will be provided by a suitable transformer connected across the 115 vac line. Again, while the metal plates 77 and 78 have been shown as connected directly in the 44 vac circuit, it will be appreciated that they could be coupled to the drive solenoid 90 through a suitable DC control relay.

In operation, when the kicker assembly 30 is at rest, it is normally disposed in a neutral position illustrated in the drawings, with the switches 121 and 125 in the position shown, and with the wiper arm 112 disposed so that the wiper finger 113*b* is disposed in the gap 119 between the right and left return pads 115 and 116 of the contact board 110, as illustrated in FIG. 7. In this position, the motor 40 is deenergized, the kicker mechanism 60 is disposed in the fully retracted position at the rear end of the track channel 74, and the drive solenoid plunger rod 95 is disposed in its fully extended position (see FIG. 2). When a pinball 24, which is typically a conductive metal ball, rolls onto the turntable 70, which has its upper surface 73 disposed substantially flush with the upper surface 22 of the playfield board 21, the conductive pinball 24 will bridge the gap 79 between the metal plates 77 and 78, thereby completing a circuit to energize the drive solenoid 90. When the drive solenoid 90 is energized, its plunger rod 95 is retracted for pivoting the drive crank 100 about the axis of the pivot pin 105, thereby moving the arm 107 forwardly to drive the kicker member 80 forwardly along the track channel 74 to bring the resilient band 89*a* thereof into kicking engagement with the pinball 24. As the pinball 24 is kicked off the turntable 70, the gap 79 between the metal plates 77 and 78 is reopened and the drive solenoid 90 is deenergized, its plunger rod 95 being driven back to its fully extended position under the urging of the compression spring 96 for sliding the kicker member 80 back to its retracted position.

It is a significant aspect of the present invention that the orientation of the kicker mechanism 60 and, therefore, the direction in which the pinball 24 will be kicked when the kicker mechanism 60 is actuated, can be selectively controlled by the player. Thus, when the player desires to move the kicker mechanism 60 to the right in a clockwise direction, as viewed in FIG. 1, from the neutral rest position, he depresses the switch button 29 for the right control switch 121. This closes pole 122 and opens pole 123 of the right control switch 121. This completes a circuit to the right control terminal R of the motor 40 through the source pad 114, the wiper fingers 113*a* and 113*c*, the right advance pad 117 and pole 122 of the switch 121 for energizing the motor 40 to rotate in the right-hand or clockwise direction. This rotation of the drive motor 40 operates, through the action of the drive chain 54 to rotate the shaft 50 and the attached kicker mechanism 60 in the clockwise or right-hand direction, as viewed in FIG. 1.

The kicker mechanism 60 will continue rotating to the right, as long as the switch 121 is held in its actuated condition, until the main plate 62 engages the enlarged portion 58 of spacer 55. As the motor shaft 42 moves in the right-hand direction (counterclockwise as viewed in FIG. 7), the wiper arm 112 rotates with it to move the wiper finger 113*b* into contact with the right return pad 115. When the switch 121 is released it will return to its normal deactuated condition, the pole 122 being reopened to deenergize the right control terminal of the drive motor 40, and the pole 123 being closed. This reclosure of the pole 123 completes a circuit to the left control terminal of the drive motor 40 through the source pad 114, the wiper fingers 113*a* and 113*b*, the right return pad 115 and the switch pole 123 for rotating the motor 40 in a left-hand direction (clockwise as viewed in FIG. 7), for returning the kicker mechanism 60 to its neutral rest position. When the kicker mechanism 60 returns to its neutral rest position, the wiper finger 113*b* will ride into the gap 119 for breaking the circuit and deenergizing the drive motor 40.

When it is desired to move the kicker mechanism 60 to the left from its neutral rest position, as viewed in FIG. 1, the left control switch 125 is depressed, opening its pole 127 and closing its pole 126. Closure of the pole 126 completes a circuit to the left control terminal of the drive motor 40 through the source pad 114, the wiper fingers 113*a* and 113*d*, the left advance pad 118 and the pole 126 for driving the motor 40 in a left-hand direction. This effects a corresponding rotation of the kicker mechanism 60 through the operation of the drive chain 54 in the manner explained above. As the wiper arm 112 moves from its neutral rest position, the wiper finger 113*b* moves into engagement with the left return pad 116. Left-hand movement of the motor 40 will continue as long as the left control switch 125 is held actuated, until the main plate 62 engages the enlarged portion 58 of the spacer 55. When the switch 125 is released to its normal deactuated condition, the pole 126 is reopened for deenergizing the left control terminal of the motor 40. At the same time, the pole 127 is reclosed for completing a circuit to the right control terminal of the drive motor 40 through the source pad 114, the wiper fingers 113*a* and 113*b*, the left return pad 117 and the pole 127 for returning the kicker mechanism 60 to its neutral position, at which position the motor 40 is again deenergized as described above.

It will be appreciated that, by use of the rotatable kicker assembly 30, a player can selectively rotate the kicker mechanism 60 in different directions so that an oncoming pinball will be kicked in a predetermined selected direction. This rotation control capability greatly increases the variations of plays available and the amount of skill involved in playing the pinball game 20.

In a constructional model of the present invention, the frame 57 and the turntable 70 are preferably formed of an electrically insulating material such as a suitable plastic. The kicker member 80 may also be formed of a plastic material. While a chain drive arrangement has been illustrated for rotation of the kicker mechanism 60, it will be appreciated that other rotational drive arrangements could be used, such as belt drive, gear drive, direct drive and the like. Also, while the kicker drive solenoid 90 is actuated by a control circuit closed by the rolling pinball 24, it will be appreciated that other types of actuation arrangements could be utilized.

From the foregoing, it can be seen that there has been provided an improved kicker assembly which is selectively rotatable in clockwise or counterclockwise directions by the player for selectively varying the direction in which an associated pinball is kicked by a kicker member which moves horizontally substantially parallel to the playfield board.

I claim:

1. A rotatable kicker apparatus for a pinball game including a playfield board on which a pinball rolls, said kicker apparatus comprising a frame supported by the playfield board and rotatable with respect thereto about an axis disposed substantially perpendicular thereto, a kicker member carried by said frame for reciprocating kicking movement along a straight linear path substantially parallel to the playfield board to engage the associated pinball and propel it along the playfield board in a predetermined direction relative to said frame, kicker drive means carried by said frame and coupled to said kicker member for effecting kicking movement thereof, and frame drive means coupled to said frame for effecting rotational movement thereof about said axis thereby to vary said predetermined direction.

2. The kicker apparatus of claim 1, wherein said frame includes a circular platform adapted to be disposed in a complementary aperture in the associated playfield board coaxially with said axis.

3. The kicker apparatus of claim 2, wherein said platform has a track formed in the upper surface thereof, said kicker member being adapted for sliding movement along said track.

4. The kicker apparatus of claim 1, and further including kicker actuating means responsive to engagement by a rolling pinball for actuating said kicker drive means.

5. The kicker apparatus of claim 4, wherein said kicker actuating means includes two spaced-apart electrically conductive members adapted to be bridged by a rolling conductive pinball for completing a conductive path therebetween.

6. The kicker apparatus of claim 1, wherein said frame drive means includes a reversible electric motor.

7. The kicker apparatus of claim 6, wherein said frame drive means further includes an endless drive member interconnecting said frame and the output shaft of said motor.

8. The kicker apparatus of claim 1, wherein said kicker drive means includes a solenoid.

9. A rotatable kicker apparatus for a pinball game including a playfield board on which a pinball rolls, said kicker apparatus comprising ball propelling means associated with the playfield board and reciprocatively movable with respect thereto along a straight linear path for engagement with an associated pinball for propelling the pinball into rolling engagement with the playfield board in a predetermined direction, drive means coupled to said ball propelling means for effecting rotational movement thereof about an axis disposed substantially perpendicular to the associated playfield board for varying said predetermined direction, and control means coupled to said drive means and shiftable between an actuating condition and a de-actuating condition, said drive means being responsive to said control means in the actuating condition thereof for rotating said ball propelling means from a normal rest position, said drive means being responsive to said control means in the de-actuating condition thereof for rotating said ball propelling means back to the normal rest position thereof.

10. The kicker apparatus of claim 9, wherein said control means includes an electric switch.

11. The kicker apparatus of claim 9, wherein said drive means is operable for rotating said ball propelling means in either direction from said rest position, said control means including two control devices for respectively controlling operation of said drive means in different directions from said rest position.

12. The kicker apparatus of claim 11, wherein said control devices comprise electric switches.

13. The kicker apparatus of claim 9, wherein said drive means comprises a reversible electric motor, said control means comprising an electric circuit interconnecting said motor and an associated source of electric power, said circuit including switch means shiftable between said actuating and de-actuating conditions, said switch means in the actuating condition thereof connecting said motor to the associated source of electric power for driving the motor in a first direction from said rest position, said switch means in the de-actuating condition thereof being responsive to displacement of said ball propelling means from its rest position for connecting said motor to the associated source of electric power for driving said motor in a second direction back to the rest position.

14. A rotatable kicker apparatus for a pinball game including a playfield board on which a pinball rolls, said kicker apparatus comprising a frame rotatable about an axis disposed substantially perpendicular to the associated playfield board, a kicker member carried by said frame for reciprocating kicking movement along a straight linear path substantially parallel to the playfield board to engage the associated pinball and propel it along the playfield board in a predetermined direction relative to said frame, kicker drive means carried by said frame and coupled to said kicker member for effecting kicking movement thereof, frame drive means coupled to said frame for effecting rotational movement thereof about said axis thereby to vary said predetermined direction, and control means coupled to said frame drive means and shiftable between an actuating condition and a deactuating condition, said frame drive means being responsive to said control means in the actuating condition thereof for rotating said frame from a normal rest position, said frame drive means being responsive to said control means in the de-actuating condition thereof for rotating said frame back to the normal rest position thereof.

15. The kicker apparatus of claim 14, and further including kicker actuating means responsive to engagement by a rolling pinball for actuating said kicker drive means.

16. The kicker apparatus of claim 14, wherein said kicker drive means includes a solenoid.

17. The kicker apparatus of claim 16, wherein said solenoid has a plunger with the axis thereof disposed substantially perpendicular to the playfield board, said kicker drive means further including linkage means interconnecting said solenoid and said kicker member for moving said kicker member parallel to the playfield board in response to operation of said solenoid.

18. The kicker apparatus of claim 14, wherein said frame drive means is operative for rotating said frame in either direction from said normal rest position.

19. The kicker apparatus of claim 18, wherein said said control means comprises electric switches.

* * * * *